US007375641B2

(12) United States Patent
Kiel et al.

(10) Patent No.: US 7,375,641 B2
(45) Date of Patent: May 20, 2008

(54) CENTRALIZED IMPLEMENTATION OF PORTAL ANNOUNCING METHOD AND SYSTEM

(75) Inventors: Gerald H. Kiel, New York, NY (US); Roberta Kiel, New York, NY (US)

(73) Assignee: Kiel Safety Portals, Inc., New York, NY (US)

( * ) Notice: Subject to any disclaimer, the term of this patent is extended or adjusted under 35 U.S.C. 154(b) by 171 days.

(21) Appl. No.: 11/399,575

(22) Filed: Apr. 6, 2006

(65) Prior Publication Data

US 2007/0222598 A1 Sep. 27, 2007

Related U.S. Application Data

(60) Provisional application No. 60/785,036, filed on Mar. 22, 2006.

(51) Int. Cl.
*G08B 23/00* (2006.01)

(52) U.S. Cl. ..... 340/573.1; 340/539.11; 340/539.13; 340/539.15; 340/825.36; 340/572.1; 340/10.1

(58) Field of Classification Search ..... None
See application file for complete search history.

(56) References Cited

U.S. PATENT DOCUMENTS 4,453,161 A * 6/1984 Lemelson ..... 340/5.63
6,348,867 B1 * 2/2002 Myllymaki ..... 340/573.1
6,930,607 B2 8/2005 Kiel et al.

* cited by examiner

*Primary Examiner*—George Bugg
*Assistant Examiner*—Son Tang
(74) *Attorney, Agent, or Firm*—Reed Smith LLP

(57) ABSTRACT

In a facility having a plurality of portals and having a number of individuals having access to the portals and where each portal is assigned a unique portal for his or her use, a system is designed which allows each individual to receive a unique voice message from his or her portal that a particular portal is the one assigned when the individual is in the proximity of his or her unique portal. The system comprises a uniquely coded element to be worn by each individual and a plurality of transponders, each transponder affixed on or near a particular portal. Each transponder has a device which emits an IR or RF scanning signal for scanning the coded element worn by a particular individual. Each said transponder has an element to determine when a detected signal has the same unique correspondence to a particular portal. The system also comprises a central computer. When there is correspondence between a detected signal or portal, a signal indicating correspondence is directed to the central portal. When a signal indicating correspondence is directed to the computer, it is used to actuate a corresponding unique audio message which is directed to the corresponding portal for audio transmission by an audio speaker located at or near the transponder of the portal.

3 Claims, 1 Drawing Sheet

CENTRALIZED IMPLEMENTATION OF PORTAL ANNOUNCING METHOD AND SYSTEM

CROSS-REFERENCE TO RELATED APPLICATION

This application is based upon provisional application No. 60/785,036, filed Mar. 22, 2006, the complete disclosure of which is hereby incorporated by reference.

BACKGROUND OF THE INVENTION a) Field of the Invention

The present invention relates to a portal announcing system and method and, in particular, a centralized implementation of such system and method.

b) Description of the Related Art

In U.S. Pat. No. 6,930,607, the disclosure of which is incorporated herein by reference, a method and system were disclosed for providing an automatic announcement to a person seeking a particular portal in a facility that any particular portal is the one sought. The method disclosed therein comprises the steps of providing the person with a wireless, electronic transmitting and/or receiving device bearing a particular code, providing the portal with a corresponding wireless, electronic transmitting and/or receiving device bearing the particular code, identifying when the code of the device of the person which had been received by the portal device is the same as the code of the portal device and announcing when the personal code and the portal code have been identified as being the same to the person that this portal is the one sought.

Applications for this disclosed method and system have been mentioned as applicable to nursing homes (e.g., Alzheimer's patients), hospitals and the like. An audible announcement would be made when an identification match occurs such as "this is your room Fanny." Infra-red or RF techniques have been disclosed as appropriate for such a system and method.

OBJECT AND SUMMARY OF THE INVENTION

The primary object of the invention is to implement the portal recognition and method using a centralized computer to achieve additional benefits. In this way, according to the invention, unique information relating to a number of individuals, their respective portals and required announcement may be stored. In this approach each individual would wear a tag with uniquely coded ID information. On the portal, a scanner would transmit an appropriate scanning signal and when the scanned return signal is recognized for a particular portal (by code comparison), a recognition signal is generated. This recognition signal would be sent to a centralized computer. The recognition signal (coded for the particular individual and portal) would be routed within the computer to stored audio information which is also uniquely coded for a particular portal. When the appropriate recognition signal is routed to its corresponding stored audio information, an audio signal (in digitized form) is released by the computer and supplied back to an audio speaker on the portal to announce that "this is your room Fanny" (or whatever other name corresponds to the respective portal). In this way, there is respective audio storage within the centralized computer corresponding to each room. Each portal would have an audio speaker connected to the audio output of the computer.

This centralized approach would make it easy and economical to change the audio information when an individual permanently leaves his or her room. Once the scanner/transponder and speaker is installed for a particular portal, only the tag to be worn and computer-stored audio need be changed when the individual permanently leaves. This makes the overall system very economical to maintain.

DESCRIPTION OF THE PREFERRED EMBODIMENTS

Figure 1:
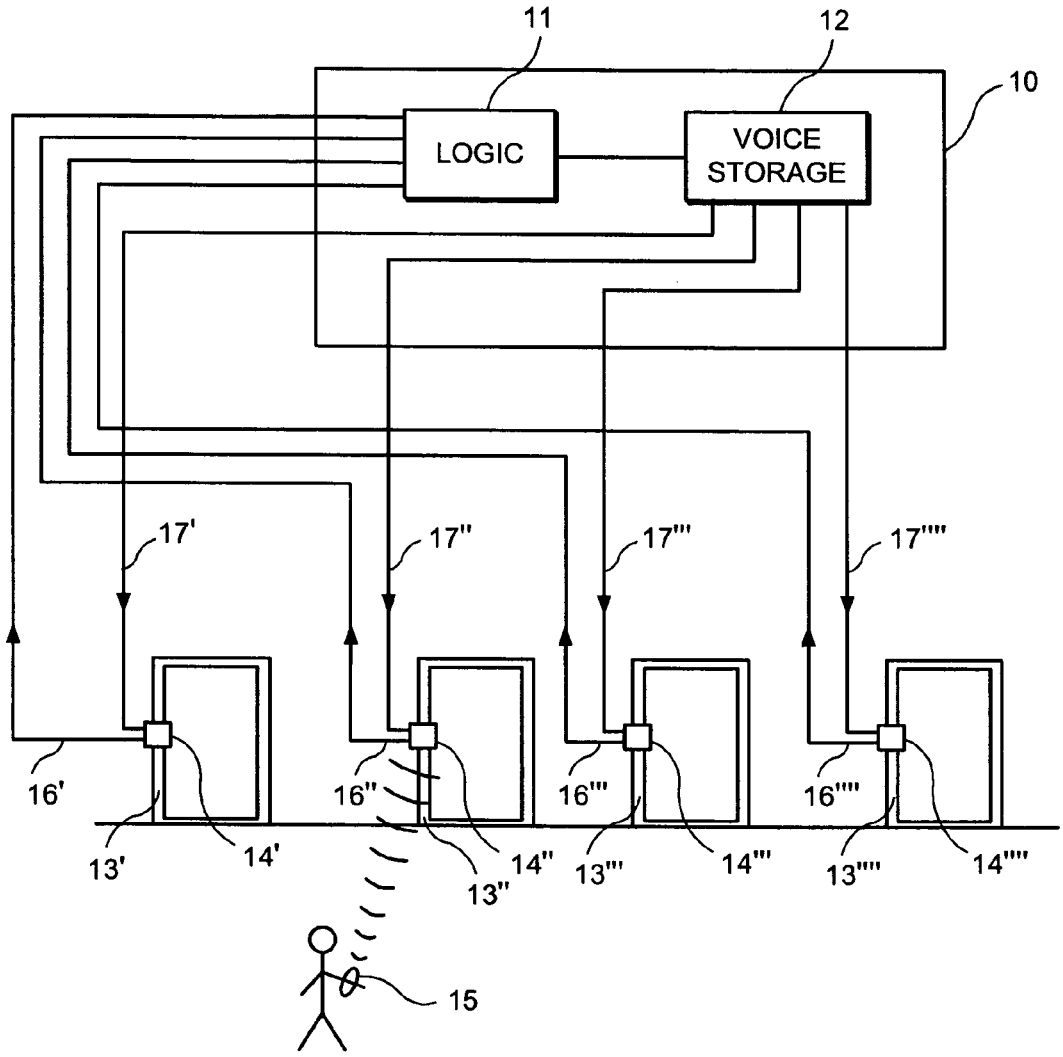
FIG. 1 is a block diagram of an arrangement in accordance with the invention.

Referring to FIG. 1, a computer 10 has specific internal logic 11 to receive a plurality of detected signals from a corresponding plurality of portals (13', 13", 13'" and 13"", for example) in a facility such as a nursing home.

On each portal is a transponder (14', 14", 14'" and 14"", for example) which emits a uniquely coded wireless signal (IR or RF). When an individual wears a device 15 with a similarly unique code, it will be reflected and/or retransmitted back to the transponder and detected as the same unique code, i.e., correspondence between the two codes will be indicated.

Each of the transponders has an output line (16', 16", 16'", 16"", for example) for carrying a signal indicating correspondence back to computer 10. The output lines are supplied to a logic block (11) for directing the detected signal to a correspondingly stored set of spoken statements, in voice storage 12, each statement uniquely corresponding to a specific individual and a specific portal. The outputs of the voice storage 12 are connected (or by wireless transmission) from the computer to corresponding portals. At each portal, preferably within the housing of the transponder, there will be a speaker (not shown) responsive to a signal coming from voice storage.

Accordingly, when an individual wears an element 15 having the unique code of a corresponding transponder 14", the transponder 14" will detect the signal and transmit it along line 16" to the computer 10. In computer 10, that signal will be further directed by logic elements within logic block 11 to a corresponding digitally stored voice message in voice storage 12 (e.g., "it's your room Fanny"). That specific message is then released as an audio signal along audio line 17" back to portal 13" where it will create an audio announcement through the speaker, "it's your room Fanny."

The centralized system may also be used to indicate particular doors having a particular function for individuals authorized to use such doors. For example, special emergency doors may indicate by audio announcement their location to firemen (such as in a smoke-filled building) while a different set of doors may, for example, be used to indicate storage of flammable material to police and/or firemen. The location and audio message for each portal (or set of portals) would be controlled by the central computer.

While the foregoing description and drawings represent the present invention, it will be obvious to those skilled in the art that various changes may be made therein without departing from the true spirit and scope of the present invention.

What is claimed is:

1. In a facility having a plurality of portals and having a number of individuals having access to the portals and where each individual is assigned a unique portal for his or her use, a system for allowing each individual to receive a unique voice message from his or her portal that a particular portal is the one assigned when the individual is in the proximity of his or her unique portal, said system comprising:

a uniquely coded element to be worn by each individual;

a plurality of transponders, each transponder affixed on or near a particular portal, each transponder having means to emit an IR or RF scanning signal for scanning the coded element worn by a particular individual;

each said transponder having means to determine when a detected signal has the same unique correspondence to a particular portal;

a central computer;

when there is correspondence between a detected signal and a portal, a signal indicating correspondence being directed to said central computer;

said central computer having stored unique audio messages, each uniquely corresponding to a particular portal; and when a signal indicating correspondence is directed to said computer, it is used to actuate a corresponding unique audio message which is directed to said corresponding portal for audio transmission by an audio speaker located at or near the transponder of said portal.

2. The system of claim 1 where said audio message is a voice message.

3. In a facility having a plurality of portals where a first group of one or more portals have a first particular function and a second group of one or more portals have a second particular function, and a first group of one or more individuals have access to the first group of portals and a second group of one or more individuals have access to the second group of portals, said first group of portals and individuals having a first unique code assigned to them and said second group of portals and individuals having a different second unique code assigned to them, the system for allowing each individual of a respective group to receive a unique voice message from a portal of said same respective group that said portal is one assigned from said respective group when said individual is in the proximity of said portal, said system comprising:

a uniquely coded element to be worn by each individual of a respective group;

a plurality of transponders, each transponder affixed on or near a particular portal, each transponder having means to emit an IR or RF scanning signal for scanning the coded element worn by a particular individual;

each said transponder having means to determine when a detected signal has the same unique correspondence to a particular portal;

a central computer;

when there is correspondence between a detected signal and a portal, a signal indicating correspondence being directed to said central computer;

said central computer having stored unique audio messages, each uniquely corresponding a particular group of portals; and when a signal indicating correspondence is directed to said computer, it is used to actuate a corresponding unique audio message which is directed to said corresponding group of portals for audio transmission by an audio speaker located at or near a transponder of each portal of said corresponding group of portals.

* * * * *